US011471907B2

(12) United States Patent
Cognon et al.

(10) Patent No.: US 11,471,907 B2
(45) Date of Patent: Oct. 18, 2022

(54) PAINT SPRAYER

(71) Applicant: EXEL INDUSTRIES, Epernay (FR)

(72) Inventors: Thibault Cognon, Paris (FR); Sébastien Salze, Paris (FR)

(73) Assignee: EXEL INDUSTRIES, Epernay (FR)

( * ) Notice: Subject to any disclaimer, the term of this patent is extended or adjusted under 35 U.S.C. 154(b) by 186 days.

(21) Appl. No.: 16/293,653

(22) Filed: Mar. 6, 2019

(65) Prior Publication Data

US 2019/0275544 A1 Sep. 12, 2019

(30) Foreign Application Priority Data

Mar. 9, 2018 (FR) ..... 18 52054

(51) Int. Cl.

| | |
|---|---|
| ***B05B 12/00*** | (2018.01) |
| ***B05B 12/08*** | (2006.01) |
| ***B05B 7/02*** | (2006.01) |

(52) U.S. Cl.

CPC ..... *B05B 12/008* (2013.01); *B05B 7/02* (2013.01); *B05B 12/085* (2013.01)

(58) Field of Classification Search

CPC ... B05B 12/004; B05B 12/006; B05B 12/008; B05B 12/085

See application file for complete search history.

(56) References Cited

U.S. PATENT DOCUMENTS

| | | | | |
|---|---|---|---|---|
| 2010/0205032 | A1* | 8/2010 | Nielsen | G06Q 10/063 705/7.11 |
| 2011/0259974 | A1* | 10/2011 | Cooper | A61M 35/003 239/70 |
| 2014/0203103 | A1* | 7/2014 | Pitman | B05B 12/085 239/71 |
| 2017/0203309 | A1* | 7/2017 | Krueger | A01M 7/006 |
| 2017/0225203 | A1* | 8/2017 | Kloepfer | B08B 3/003 |
| 2017/0259288 | A1* | 9/2017 | Scott | B05B 12/002 |
| 2017/0259290 | A1 | 9/2017 | Kraft et al. | |
| 2020/0114377 | A1* | 4/2020 | Barthelmes | B05B 5/0255 |

FOREIGN PATENT DOCUMENTS

| | | | |
|---|---|---|---|
| CN | 1083545 | C | 4/2002 |
| CN | 105057136 | A | 11/2015 |
| CN | 104415868 | B | 5/2019 |
| CN | 107073490 | B | 3/2020 |
| DE | 102011004024 | A1 | 8/2012 |
| JP | 2014018712 | A | 2/2014 |
| WO | 2003086653 | A1 | 10/2003 |
| WO | 2005075088 | A2 | 8/2005 |
| WO | 2014006593 | A1 | 1/2014 |

OTHER PUBLICATIONS

INPI Rapport de Recherche Préliminaire for French Patent Application No. 1852054, dated Nov. 7, 2018, 2 pp.
EPO Translation for Publication No. JP2014018712A.

* cited by examiner

*Primary Examiner* — Cody J Lieuwen
(74) *Attorney, Agent, or Firm* — Soquel Group LLC

(57) ABSTRACT

A paint sprayer including a base and a plurality of components mounted on the base, including a gun mounted on the base, a head mounted on the gun and a nozzle mounted on the head, wherein the paint sprayer further includes at least one sensor.

8 Claims, 1 Drawing Sheet

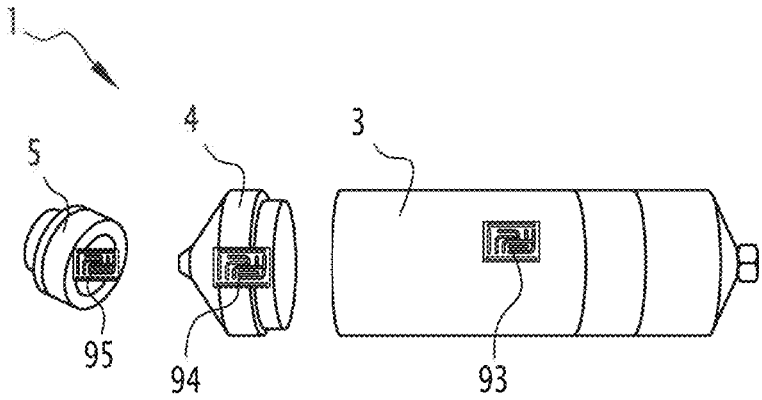
1
5
4
3
95
94
93
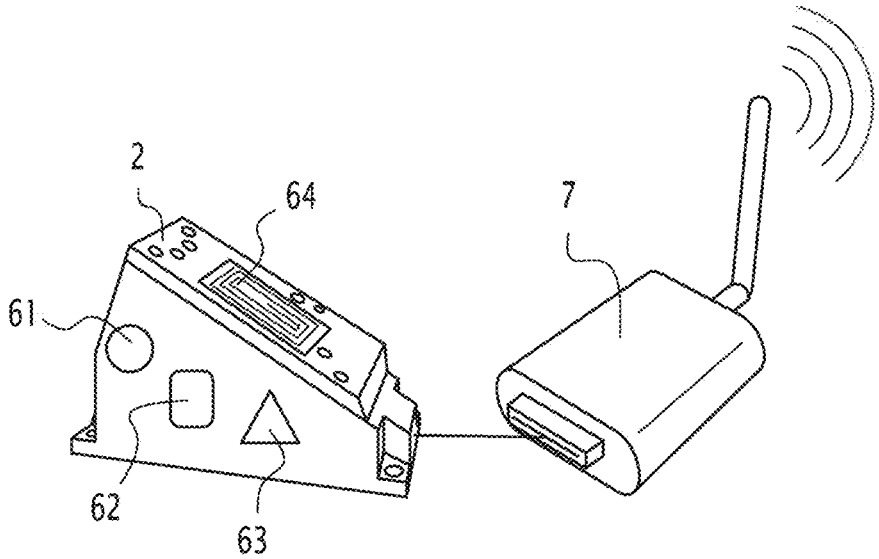
2
64
7
61
62
63
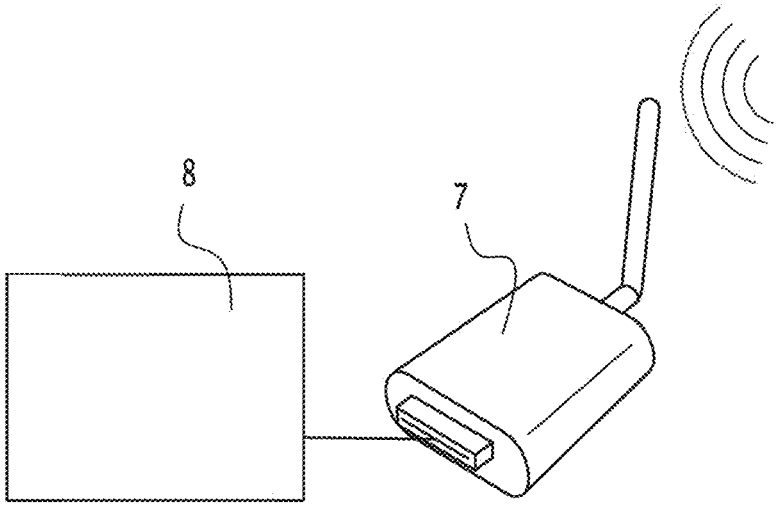
8
7

PAINT SPRAYER

CROSS-REFERENCE TO RELATED APPLICATION

This application claims priority of French Patent Application No. 18 52054, filed on Mar. 29, 2018.

FIELD OF THE INVENTION

The present invention relates to industrial production equipment, and more particularly a paint sprayer comprising components able to be changed.

BACKGROUND OF THE INVENTION

It is known in the field of paint spraying to mount one or several components on a base depending on the desired type of spraying. Thus typically mounted on a base is a gun that may change depending on the type of spraying or paint. Head equipment is mounted on said gun. This head equipment may include a head mounted on the gun and a base mounted on the head. The head and the nozzle individually or jointly determine the sprayed flow rate and/or the shape of the spray beam. A change to the flow rate and/or shape is done by changing the head and/or nozzle. Thus, from one component to the other, it is possible to change a parameter of the method, even when the interface of the component stays the same, so as indeed to allow the interchangeability.

Thus, several configurations are possible by changing one or the other of the components of the series. Some components are compatible with the base and/or each other, and others are not. Currently, the configuration management is done manually by the operator.

SUMMARY OF THE INVENTION

The present invention aims to automate the configuration management of a sprayer. This automation is advantageously used in order simultaneously to perform other processing: diagnostics, history, etc.

The invention relates to a paint sprayer including a base and a plurality of components mounted on the base, such as: a gun mounted on the base, a head mounted on the gun and a nozzle mounted on the head, and at least one sensor able to measure a feature of the sprayer.

Other optional features may modify the sprayer:

- the at least one sensor is integrated into the base,
- the sprayer further includes a communication means and a processing unit, the communication means being able to send the information from the at least one sensor to the processing unit,
- the at least one sensor is chosen from among: an opening sensor able to measure an opening of the sprayer, an air pressure sensor able to measure an air pressure arriving at the sprayer and/or a paint pressure sensor able to measure a paint pressure arriving at the sprayer,
- at least one, preferably each, of the components is equipped with a unique identifier and the at least one sensor further comprises a sensor able to recognize the identifier, and preferably an identifier includes an RFID tag and the sensor includes an RFID reader,
- the processing unit is configured to conduct a validity analysis of the configuration by analyzing the combination of the identifiers of the components,

- the processing unit is configured to conduct a proper operation diagnosis by analyzing the parameters measured by the at least one sensor,
- the processing unit is configured to perform a usage history of each component.

BRIEF DESCRIPTION OF THE DRAWINGS

Other features, details and advantages of the invention will emerge more clearly from the detailed description provided below, for information and in reference to the drawings, in which:

FIG. 1 shows one embodiment of a sprayer, in accordance with an embodiment of the invention.

DETAILED DESCRIPTION OF THE INVENTION

As illustrated for information in FIG. 1, a paint sprayer 1 includes a base 2. On this base 2, it is possible to mount a plurality of components 3, 4, 5, directly on the base or on one of the other components. Thus according to one possible assembly, a gun 3 is mounted on the base 2, a head 4 is mounted on the gun 3, and a nozzle 5 is mounted on the head 4. Other configurations, in series, in parallel, or with other components, are possible. In the case of a paint sprayer 1, the shape of the paint beam is for example determined by the nozzle 3. A change of beam shape is done by changing the nozzle 3.

In order to determine the operating and configuration parameters of a sprayer 1, the latter further includes at least one sensor 61-64 able to measure a characteristic of the sprayer 1.

According to one feature, the at least one sensor 61-64 is integrated into the base 2. This is advantageous in that the base occupies a central position in the sprayer 1 and sees the passage of all of the lines (air, paint), easily making it possible to take measurements.

The interest of collecting the information obtained by said at least one sensor 61-64 lies in gathering all of said information and, if applicable, the information from several sprayers 1 to process it within a processing unit 8. The processing unit 8 is advantageously central and may be offloaded from the sprayer 1. Additionally, a sprayer 1 advantageously includes a communication means 7 able to send the information from the at least one sensor 61-64 to the processing unit 8.

The at least one sensor 61-64 may target an operating parameter of the sprayer 1. Thus, the at least one sensor 61-64 may be an opening sensor 61. Such an opening sensor is able to measure an opening of the sprayer 1. This opening information can be analog: opening rate, or binary: the sprayer 1 is open, in the process of spraying, or closed.

The at least one sensor 61-64 may also be an air pressure sensor 62. Such a sensor is able to measure an air pressure arriving at the sprayer 1.

The at least one sensor 61-64 may further be a paint pressure sensor 63. Such a sensor is able to measure a paint pressure arriving at the sprayer 1.

These operating parameters of the sprayer allow an observation of the operation of the sprayer. Their combination makes it possible to diagnose proper operation.

In addition to an observation of the operation of the spraying, it is advantageous to know the configuration of the sprayer 1. To that end, at least one, preferably all of the components 3, 4, 5, is equipped with a unique identifier 93, 94, 95. In this case, the at least one sensor also includes a sensor 64 able to recognize the identifier 93, 94, 95.

According to one preferred embodiment, an identifier 93, 94, 95 includes an RFID tag (acronym for: Radio Frequency Identifier) and the sensor 64 includes an RFID reader, able to read such an RFID tag.

Thus modified according to the invention, a sprayer 1 is able to observe parameters of its operation and to collect identifiers indicative of its configuration. Using the communication means 7, all of this information can be escalated to the processing unit 8 for analysis and/or recording.

Using identifiers 93, 94, 95 of the components 3, 4, 5, read by the sensor 64, the processing unit 8 can be configured to conduct a validity analysis of the configuration. This is typically done by analyzing the combination of the identifiers 93, 94, 95 of the components 3, 4, 5. Thus, it is possible to verify that an assembled nozzle 5 is indeed of a type compatible with the gun 3 and/or the head 4 used (technical compatibility). It may further be verified that a nozzle 5 is indeed a nozzle recommended and/or sold by the builder (commercial compatibility). An alarm and/or blockage of the spraying method may be triggered if not.

This configuration information, indicating which components are assembled, makes it possible to perform an inventory management of the components by offering knowledge of the assembled components and/or components available in the warehouse.

According to another feature, the measurements of the spraying parameters and, if applicable, the configuration information, make it possible to perform a proper operation diagnosis. Thus, the processing unit 8 is advantageously configured to conduct a proper operation diagnosis by analyzing the parameters measured by the at least one sensor 61-64. This diagnostic may for example verify that the opening sensor 61 indeed indicates an opening of the sprayer 1 when this opening is commanded. According to another example, the diagnostic may compare an air pressure signal, respectively paint pressure, when the sprayer 1 is open, with the expected value of the air pressure, respectively paint pressure. This expected value may depend on the head 4 and/or the nozzle 5 used, known via the sensor 64. The diagnostic is preferably done in real-time. It may trigger an alarm and/or block the spraying method when a diagnostic indicates incorrect operation.

According to another feature, the processing unit 8 is configured to perform a usage history of each component 3, 4, 5. From the configuration information, identifier 93, 94, 95 read by the sensor 64, it is possible, by adding the time, to trace which component 3, 4, 5 was used at what moment. It is thus possible to determine the usage duration or the wear of a component 3, 4, 5. By crossing this with the operating measurements, it is possible to refine the wear measurements. Thus, the lifetime of the gun 3 is measured in number of openings. The lifetime of a nozzle or a head is measured in quantity of paint having passed through it. All of these measurements can be done with the sensors 61-64. The usage history is advantageously used to perform preventive maintenance of the sprayer 1 by changing each component 3, 4, 5 in time.

The invention may be adapted to a spraying robot or the base corresponds to the body and/or the skirt of the sprayer. The head and/or the nozzle is replaced by a rotary bowl.

The invention may also be adapted to a manual spray gun or the base is replaced by the gun.

The invention claimed is:

1. A paint sprayer for spraying a paint beam, comprising:
a base, passed through by a line of paint;
a plurality of components forming the paint beam with the paint from the line, each component being equipped with a respective unique identifier, the plurality of components comprising:
at least one gun mountable on said base, such that when a gun of the at least one gun is mounted on said base to comprise a mounted gun, paint from the line passes through the mounted gun;
at least one head mountable on said at least one gun, such that when a head of the at least one head is mounted on the mounted gun to comprise a mounted head, paint from the line passes through the mounted head; and
at least one nozzle mountable on said at least one head, such that when a nozzle of the at least one nozzle is mounted on the mounted head to comprise a mounted nozzle, paint from the line passes through the mounted nozzle, and the mounted nozzle determines a shape of the paint beam;
a sensor recognizing the unique identifiers of currently mounted components; and
a processing unit configured to conduct a validity analysis of a configuration of the currently mounted components, to verify that the mounted nozzle is technically compatible with the mounted gun and/or with the mounted head by analyzing the unique identifier of the mounted gun and the unique identifier of the mounted head and the unique identifier of the mounted nozzle, as recognized by said sensor.

2. The paint sprayer according to claim 1, wherein said sensor is integrated into said base.

3. The paint sprayer according to claim 1, further comprising an opening sensor able to measure an opening of the paint sprayer.

4. The paint sprayer according to claim 1, wherein said processing unit is configured to conduct a proper operation diagnosis by analyzing parameters measured by said sensor.

5. The paint sprayer according to claim 1, wherein said processing unit is configured to perform a usage history of each said component.

6. The paint sprayer according to claim 1, wherein the identifier comprises an RFID tag and said sensor comprises an RFID reader.

7. The paint sprayer according to claim 1 wherein a line of air passing through said base forms the paint beam with the paint, the paint sprayer further comprising an air pressure sensor measuring an air pressure arriving at the paint sprayer by the line of air.

8. The paint sprayer according to claim 1 further comprising a paint pressure sensor measuring a paint pressure arriving at the sprayer.

* * * * *